United States Patent [19]

Drogosch

[11] Patent Number: 4,550,535

[45] Date of Patent: Nov. 5, 1985

[54] COPING SYSTEM

[76] Inventor: Edward J. Drogosch, 27049 Grand River, Redford, Mich. 48240

[21] Appl. No.: 515,792

[22] Filed: Jul. 21, 1983

[51] Int. Cl.[4] ..... E04D 13/14; E04F 19/02

[52] U.S. Cl. ..... 52/60; 52/94; 52/300

[58] Field of Search ..... 52/57–63, 52/94, 95, 96, 102, 300, 401, 459, 769; 24/530, 532, 545; 248/214, 489; 160/399, 402

[56] References Cited

U.S. PATENT DOCUMENTS

| | | | |
|---|---|---|---|
| Re. 28,870 | 6/1976 | Attaway et al. | 52/58 |
| 3,132,445 | 5/1964 | Swanson | 52/58 |
| 3,405,485 | 10/1968 | Edwards | 52/96 |
| 3,738,068 | 6/1973 | Attaway | 52/94 |
| 4,083,158 | 4/1978 | Wolma | 52/96 |
| 4,271,643 | 6/1981 | Sweers | 52/95 |
| 4,411,120 | 10/1983 | Ellis et al. | 52/94 |

FOREIGN PATENT DOCUMENTS

| | | | |
|---|---|---|---|
| 2150398 | 10/1979 | Fed. Rep. of Germany | 52/58 |

OTHER PUBLICATIONS

Sweet's Catalog File, McGraw Hill Information Systems Co., N.Y., N.Y., p. 11, 7.2 Ba, 1979.

*Primary Examiner*—John E. Murtagh
*Assistant Examiner*—Andrew Joseph Rudy
*Attorney, Agent, or Firm*—Cullen, Sloman, Cantor, Grauer, Scott & Rutherford

[57] ABSTRACT

A coping system for covering the top of a wall comprising an inverted U-shaped cleat which is covered by a coping panel. The cleat has an anchor leg adapted to be secured to a first side of the wall and extends upwardly above the plane of the top of the wall. The top leg of the cleat is secured to the portion extending above the top of the wall and is resiliently biased into engagement with the top of the wall. The cleat overhangs the second side of the wall and has an interior leg extending downwardly from the top leg on the inside of the wall. The cleat is covered by a coping panel which engages the anchor leg of the cleat and is fitted over the top leg and interior leg of the cleat. The cleat and panel are secured together by means of a mechanical fastener on the inside of the wall. The coping system generally includes a plurality of cleats placed at intervals along the wall and adjacent coping panels which are adapted to be attached to the cleats to enclose the top of an entire wall. A joining panel is provided between adjacent coping panels to span the space formed between adjacent coping panels which allows for thermal expansion and contraction.

5 Claims, 7 Drawing Figures

Fig-1
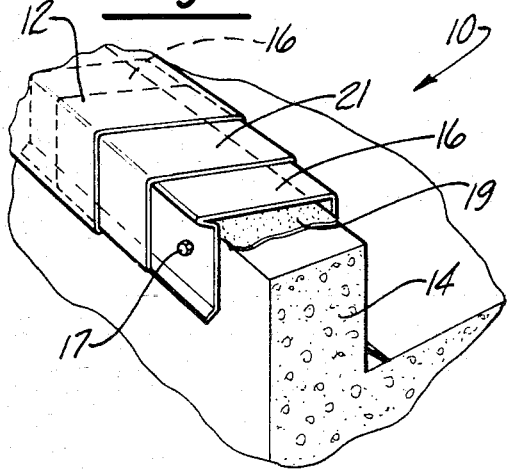
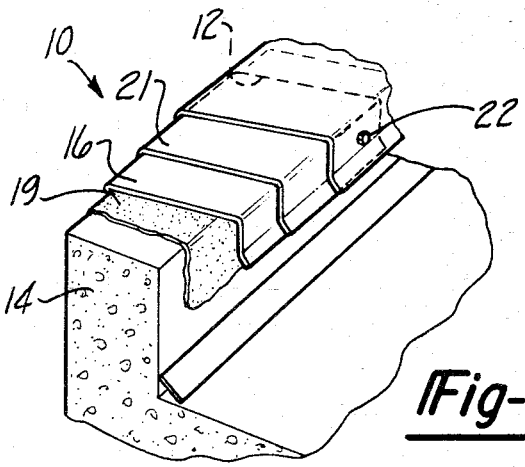
Fig-2
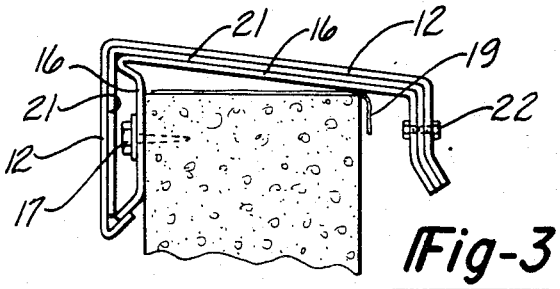
Fig-3
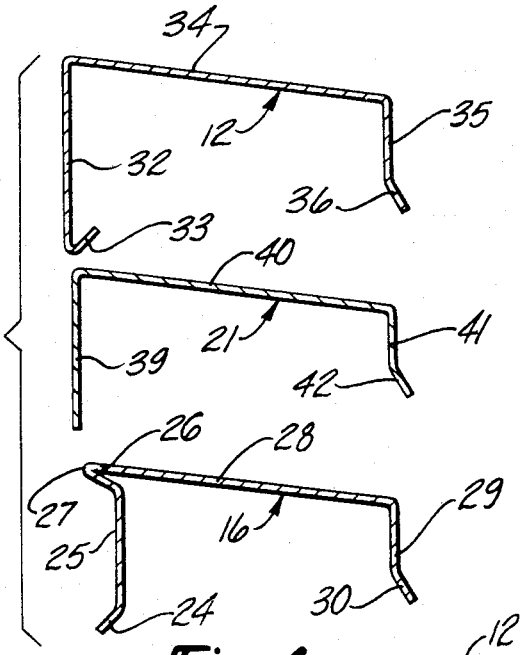
Fig-4
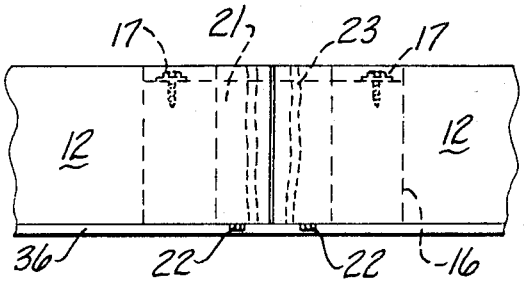
Fig-5
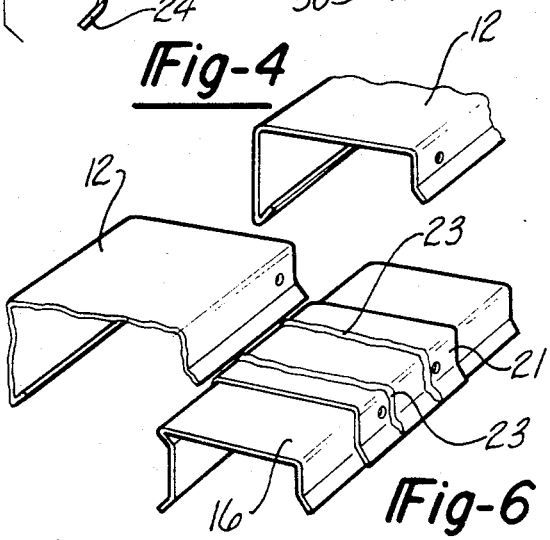
Fig-6
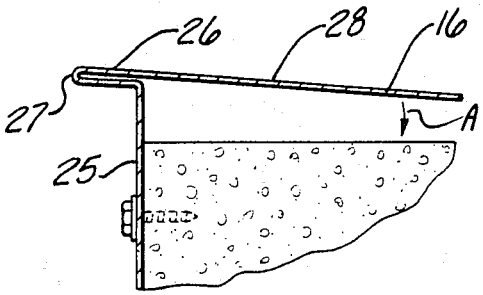
Fig-7

COPING SYSTEM

BACKGROUND OF THE INVENTION

1. TECHNICAL FIELD

The present invention relates to a coping system including a formed sheet metal cleat and formed sheet metal coping panel for covering the top of a wall. More specifically, the present invention relates to a full-width inverted U-shaped sheet metal cleat adapted to be secured to one side of a wall and to which a sheet metal coping panel is secured.

2. PRIOR ART

Coping is used to cover the top edge of a wall for preventing water from entering the top of the wall. If water is permitted to seep into a masonry or cement wall, the wall can quickly become damaged by the action of the water. Covering the top of a wall with a sheet metal panel is an effective way to prevent water from damaging a wall.

Many systems have been developed to anchor sheet metal coping to the top of a wall. One such system is a sheet metal coping system in which formed sheet metal coping is secured to a continuous cleat that is in turn fastened to a wooden strip or nailer which is secured to the top of a wall to facilitate attachment of coping to the wall. When a sheet metal coping includes a nailer problems are frequently encountered in securing the nailer to the top of a wall. Also, the nailer and coping system must be periodically replaced, especially if moisture is permitted to reach the nailer.

Extruded coping systems have been developed to eliminate the need in coping systems for a wooden nailer. In extruded coping systems, sections of extruded coping are formed in ten or 12 foot lengths. The extruded coping includes an interior web which is configured to support the extruded coping on the wall. A bar and anchor fasteners are frequently used to hold the extruded coping on top of the wall. The anchor fasteners are preferably embedded in the mortar of the wall to provide a secure fastening system for the coping. Seams between adjacent sections of extruded coping are bridged by a cover plate formed of sheet metal for preventing water from leaking between adjacent coping sections.

While extruded coping systems eliminate the problems associated with the use of a wooden nailer, extruded coping is expensive and is dedicated to a limited range of wall sizes. If anchor fasteners are used, they must be embedded in the masonry prior to laying the final course of brick which makes this system not well-suited for existing walls.

SUMMARY OF THE INVENTION

The coping system of the present invention features a unique cleat for securing the coping to the top of the wall. The cleat is secured to one side of a wall and has an integral spring portion which biases the cleat into engagement with the top of the wall. A coping panel is fitted over and secured to the cleat to complete a section of the coping system.

In most applications, more than one coping panel is used to cover an entire wall. Therefore, a plurality of coping panels must be installed on a wall adjacent to one another. The slight gap between adjacent coping panels is spanned by a joint plate to prevent leakage of water between the panels. Caulking is applied to the joint plate on both sides of the gap to form a seal between the coping panels and the joint plate.

According to a preferred embodiment of the present invention, a reversely bent spring force creating section is provided between the anchoring leg and the top leg of the cleat to bias the top leg toward the top surface of the wall.

The interior leg of the cleat extends downwardly from the top leg inside the wall and defines a clearance space between the interior leg and the wall. When the coping panel is fitted over the cleat the clearance space permits a fastener such as a rivet to be used to secure the panel to the cleat. A clearance space is also provided by the cleat on the exterior side of the wall so that the fasteners used to secure the cleat to the wall are enclosed by the coping panel.

The coping system of the present invention does not require the use of a wooden nailing strip for securing the coping system to the top of a wall. The installation of the coping system is thereby simplified and the life of the coping system is also extended.

The coping system of the present invention may be used on new or pre-existing buildings. The coping system does not require that anchor fasteners be embedded into the masonry work prior to completion of the wall.

According to the present invention, there is no need to penetrate or anchor anything to the top surface of the wall because the unique cleat is secured to one side of the wall and is spring biased into engagement with the top of the wall. This is an important advantage realized by the invention because the primary purpose of the coping system is to protect the top of the wall.

These and other advantages of the invention will become more apparent upon reading the following description and studying the attached drawings.

BRIEF DESCRIPTION OF THE DRAWINGS

FIG. 1 is a fragmentary perspective view of the coping system of the present invention secured to a wall and viewed from the exterior side of the wall.

FIG. 2 is a fragmentary perspective view of the coping system secured to a wall and viewed from the interior side of the wall.

FIG. 3 is a cross-sectional view taken along FIG. 1 showing the coping system attached to a wall.

FIG. 4 is an exploded cross-sectional view of the cleat, coping panel and joint plate of the present invention.

FIG. 5 is a fragmentary plan view showing a joint plate attached to the end of two adjacent coping panels to span the seam between the adjacent coping panels.

FIG. 6 is an exploded perspective view of the cleat with the joint plate attached and showing the ends of two coping panels.

FIG. 7 is a fragmentary cross-sectional view of the spring force creating portion of the cleat shown attached to a cement block.

DETAILED DESCRIPTION

Referring now to FIGS. 1–3, the coping system 10 of the present invention is shown installed on a building. The coping system 10 includes coping panels 12 which are secured to the top of a wall 14 by means of a plurality of cleats 16. The cleats 16 are shorter in length than the coping panels 12 and are spaced along the wall at intervals corresponding to the ends of adjacent coping panels 12. The cleats extend across the full width of the wall 14 and are preferably secured to one side of the wall 14 by means of mechanical fastener 17 such as a masonry screw.

A joint plate 21 is provided between abutting coping panels 12 to bridge the space between adjacent coping panels 12. Sufficient clearance must be provided between adjacent coping panels 12 to accommodate thermal expansion and contraction of the coping panels 12. A bead of caulking 23 is applied to the joint plate 21 on both sides of the space to prevent moisture from seeping under the abutting coping panels 12. The joint plate 21 is preferably secured to each of the coping panels 12 and the cleat 16 by means of a mechanical fastener 22 such as a rivet.

The coping system 10 covers a liner of roofing paper 19 that is installed on top of the wall 14 to provide a moisture barrier.

It should be readily appreciated that the coping system of the present invention does not require any fasteners to be secured to the top of the wall 14. Therefore, installing the coping system does not effect the structural integrity of the top surface of the wall.

Referring now to the lower cross-sectional shape in FIG. 4, the structure of the cleat 16 will be described in more detail. The cleat 16 includes an exterior flange 24 or lip which extends outwardly from the anchor leg 25. The anchor leg 25 is a substantially vertical section adapted to be secured to the exterior surface of the wall 14. The anchor leg 25 extends upwardly above the plane of the top surface of the wall and is connected to the top leg 28 of the cleat 16. The reverse bend 26 is formed at the junction of the anchor leg 25 and the top leg 28 and includes a bight 27 that biases the top leg 28 into engagement with the top of the wall 14. As shown in FIG. 7, the reverse bend 26 and bight 27 cause the top leg 28 to act like a spring clip exerting a spring force, indicated by the arrow "A," which holds the entire coping assembly firmly in engagement with the top of the wall 14. An interior leg 29 is formed at the opposite end of the top leg 28 from the anchor leg and extends vertically and downwardly from the top leg. The interior leg 29 is preferably spaced inwardly from the interior surface of the wall 14. The interior leg 29 terminates in an interior flange or lip 30 which directs precipitation away from the side of the wall and stiffens the interior leg 29.

The coping panel 12 is the exterior cover of the coping system 10 and is shown as the uppermost cross-sectional shape in FIG. 4. The coping panel 12 includes an exterior face 32 which is adapted to be fitted over the anchor leg 25 of the cleat 16. The exterior face 32 terminates on its lower end in a reversely bent clip 33 which engages the exterior flange 24, as shown in FIG. 3. The coping panel 12 includes a top face 34 and an inner face 35 which overlay the top leg 28 and interior leg 29 of the cleat 16 respectively. The inner face 35 terminates on its lower end in an inner flange or lip 36 which overlays the interior flange 30 of the cleat 16.

As shown in FIGS. 3, 5 and 6, the joint plate 21 is attached to the top surface of the cleat 16 and under two adjacent coping panels 12 to span the space between the coping panels 12. Referring now to FIG. 4, the joint plate 21 has an exterior face 39 which corresponds with the exterior face 32 of the coping panel and a top face 40 which corresponds to the top face 34 of the coping panel 12. An inner face 41 corresponding to the inner face 35 of the coping panel 12 terminates in an inner flange 42 which corresponds to the inner flange 36 of the coping panel 12. The joint plate 21 is preferably mounted between the coping panel 12 and the cleat 16 to give the coping system the appearance of a continuous member. The joint plate 21 in the preferred embodiment does not include a reversely bent clip since it is held in place by the coping panels 12.

If the joint plate 21 were to include a reversely bent clip corresponding to reverse bent clip 33, the clip 33 of the coping panels 12 would have to be flared slightly to cover the joint plate 21.

INSTALLATION

Installation of the coping system of the present invention will be described next with reference to the drawings and the above description. A description is provided of the steps required to install a single section of the coping system and it will be understood that other sections will be coupled thereto and require repeating of the installation steps.

The first step in installing the coping system 10 is to attach the cleat 16 to the wall with the anchor leg 25 in engagement with the exterior surface of the wall 14. The cleat 16 is installed on the walls with the top portion of the anchor leg 25 extending above the top of the wall a predetermined distance so that a spring biasing force is exerted against the top of the wall by the top leg 28. A gauge or template is used to measure the length of the top portion of the anchor leg which extends above wall 14. The anchor leg 25 is then fastened to the wall by means of mechanical fasteners 17 such as masonry screw or nails. Usually all of the cleats 16 are anchored on the wall before the other parts of the coping system are assembled.

Generally, the roofing paper is applied to the roof and top of the wall 14 prior to installation of the coping system. The spring force exerted by the top leg 28 should be quite sufficient to hold the roofing paper 19 in place on top of the wall 14.

As shown in FIG. 6, the joint plate 21 is then placed over the cleat at the point where the ends of two coping panels 12 are to be attached to the cleat 16. The caulking is then applied to the top surface of the joint plate 21 on both sides of the space to be formed between adjacent coping panels.

The coping panel 12 is then fitted over the cleat 16 and joint plate 21 by first hooking the reverse bent clip 33 of the coping panel 12 over the exterior flange 24. The coping panel 12 is then rotated in the clockwise direction, as viewed in FIG. 3, until the top face 34 and inner face 35 lie upon the top leg 28 and interior leg 29 of the cleat 16.

Assembly of the section is then completed by fastening the cleat 16, joint plate 21 and coping panel 12 together by means of a mechanical fastener or rivet 22 which is installed on the interior side of the wall through the inner face 35 of the coping panel 12. Additional fasteners 22 may be used if it is desirable to secure the cleat 16 and coping panel 12 together at more than one location.

The next adjacent coping panel 12 is then installed and secured on the other end of the joint plate 21, as shown in FIG. 5.

The entire construction is formed from sheet metal and may be fabricated, if required, at a construction site or fabricated off site as a prefabricated coping system.

The cleat 16 is formed from a resilient and corrosion resistent metal, preferably galvanized steel. Steel is suitable because it can extert considerable spring biasing force against the top of the wall when properly installed on the wall 14. The steel should be galvanized to prevent corrosion to thereby assure that the coping system will be durable and long-lasting. The joint plate 21 and coping panel 12 may be aluminum sheet, vinyl clad steel or any other type of sheet material that can be formed into the desired configuration.

The foregoing is a complete description of a preferred embodiment of the present invention. Various changes and modifications may be made without departing from the present invention.

What is claimed is:

1. A coping system covering a top of a wall comprising:

a substantially inverted U-shaped continuous cleat having an anchor leg secured to a first side of the wall and extending upwardly from the top of said wall, an interior leg disposed adjacent to a second side wall, a top leg extending substantially in a single plane between the anchor leg and interior leg, formed means interconnecting the anchor leg and the top leg at a location spaced upwardly from the top of said wall near the first side, said formed means comprises a reversely bent portion of said cleat having a flange portion extending at an oblique angle outwardly from the anchor leg at a point spaced upwardly from the top of the wall in a direction generally away from the first side of the wall, a bight being formed at the outermost point of the flange portion which contiguously interconnects the flange portion to the top leg to form the reversely bent portion which biases the top leg toward the top of the wall when the cleat is installed thereon to hold the coping system firmly into engagement with the top of the wall adjacent the second side; and a coping panel having an exterior face overlaying the anchor leg, a top face overlaying the top leg, an interior face overlaying the interior leg, and means for gripping the anchor leg being formed on said exterior face.

2. The coping system of claim 1 wherein a plurality of cleats are secured to the wall at spaced intervals, a plurality of coping panels are attached to the cleats to be adjacent to one another in end to end relation, and a joint plate is attached to each of said cleats, said joint plate being located between the cleat and each two adjacent coping panels whereby said joint plate spans the space formed between the coping panels.

3. In the coping system of claim 2 having a mechanical fastener for securing the interior face of the coping panel to the interior leg of the cleat and to the interior face of the joint plate for holding the coping system together.

4. The coping system of claim 1 wherein an exterior flange is formed on the opposite end of the anchor leg from the reversely bent portion whereby a clearance space is formed therebetween in which the head of a mechanical fastener may be covered by the coping panel.

5. The coping system of claim 1 wherein the interior leg of the cleat extends inwardly from the second side of the wall to form a clearance space therebetween to provide access for the installation of a fastener.

* * * * *